United States Patent [19]

Wiegard et al.

[11] 4,098,323

[45] Jul. 4, 1978

[54] SEAL FOR A REGENERATIVE HEAT-EXCHANGER

[75] Inventors: Klaus Wiegard, Esslingen-Zollberg; Johann Heil, Winnenden, both of Fed. Rep. of Germany

[73] Assignee: Daimler-Benz Aktiengesellschaft, Fed. Rep. of Germany

[21] Appl. No.: 623,254

[22] Filed: Oct. 17, 1975

[30] Foreign Application Priority Data

Oct. 29, 1974 [DE] Fed. Rep. of Germany ..... 2451247

[51] Int. Cl.[2] ..... F28D 19/00

[52] U.S. Cl. ..... 165/9; 277/96

[58] Field of Search ..... 165/9; 277/96, 96.1

[56] References Cited

U.S. PATENT DOCUMENTS

| | | | |
|---|---|---|---|
| 3,743,008 | 7/1973 | Zeek et al. | 165/9 |
| 3,761,101 | 9/1973 | Good et al. | 165/9 |
| 3,913,926 | 10/1975 | Rao | 165/9 |
| 3,954,135 | 5/1976 | Hewlitt | 165/9 |

*Primary Examiner*—Albert W. Davis, Jr.

*Assistant Examiner*—Theophil W. Streule, Jr.

*Attorney, Agent, or Firm*—Craig & Antonelli

[57] ABSTRACT

A seal for gas channels of a regenerative heat-exchanger with respect to the interior space of the housing surrounding gas channels and a storage body, which consists of a sealing bar that abuts with a slide layer at the storage body and of a sealing diaphragm which is supported at a support member provided with covered off notches and which extends obliquely over the gap between the sealing bar and the oppositely disposed housing wall and abuts at the housing wall with its upper edge projecting beyond the sealing bar; the support member thereby forms an acute angle in cross section whose one leg abuts flat at the sealing bar and is secured thereat only within the area of its edge opposite the angle apex, whereas a sealing diaphragm is secured to the other obliquely extending leg at the inside within the area of the angle apex which is assembled of individual sealing lamellae that mutually overlap between two notches of the support member and that, within the area of their overlap, are pressed against the support member by angularly bent leaf springs.

14 Claims, 9 Drawing Figures

FIG. 2
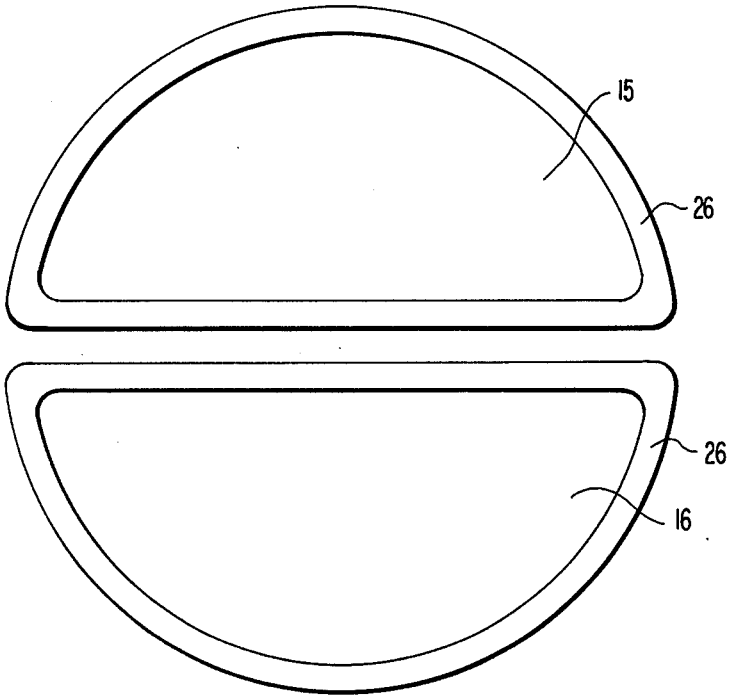
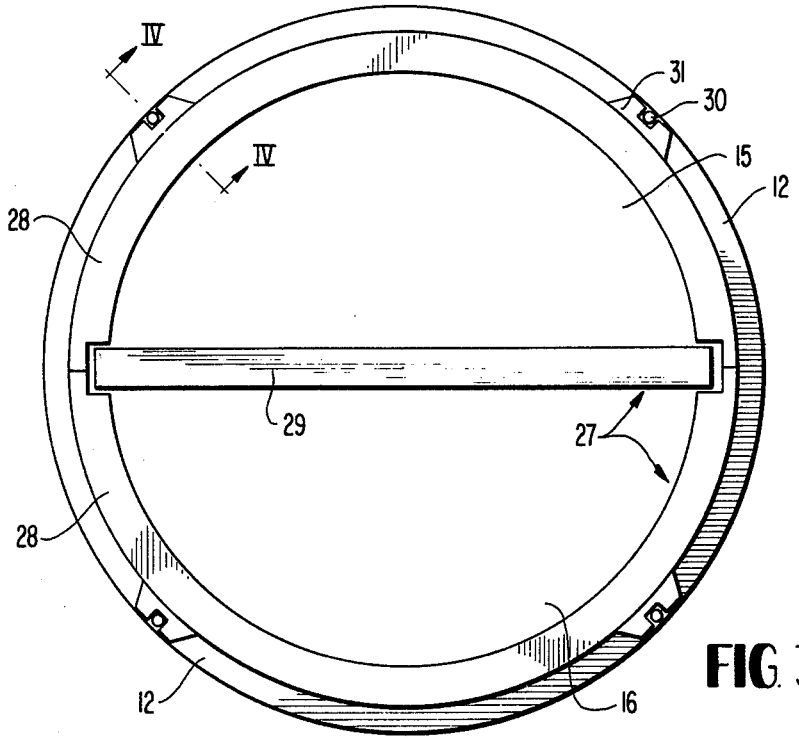
FIG. 3

SEAL FOR A REGENERATIVE HEAT-EXCHANGER

The present invention relates to a sealing system for gas channels of a regenerative heat-exchanger leading to a rotatable disk-shaped storage body, with respect to the interior space of the housing surrounding the gas channels and the storage body, which consists respectively of an endless sealing bar, that abuts by means of a slide layer at the storage body, and of a sealing diaphragm which is supported at a sheet metal support member provided with covered-off cuts or notches and which extends obliquely over the gap between the sealing bar and the oppositely disposed housing wall and abuts at the housing wall by means of its upper edge projecting beyond the sealing bar.

Since during the operation of the heat-exchanger, changes in the spacing between the heat-exchanger disk and the oppositely disposed housing wall result owing to the different thermal expansions, the inclined position of the sealing diaphragm also changes correspondingly. However, a widening or narrowing of the circumference of the edge of the sealing diaphragm abutting at the housing wall is necessarily connected therewith.

With the one-piece sealing diaphragm of such types of seals (U.S. Pat. No. 3,542,122), this may lead to warpings within the area of the edge of the sealing diaphragm whereby the sealing diaphragm lifts off in some places from the housing wall. Additionally, the tight abutment of the sealing diaphragm of such seals is further impaired by the fact that the sealing diaphragm is secured directly at the edge of the sealing bar facing the low pressure. This produces a high thermal load of the connecting places facing the hot exhaust gases in the seal of the exhaust gas channel particularly also by reason of the wall thickness differences between the very thin sealing diaphragm and the relatively thick sealing bar, which leads to further deformation of the sealing diaphragm and therewith to a further loss of its tight abutment at the housing wall.

The present invention is concerned with the task to eliminate these disadvantages and to provide a seal which abuts reliably at the housing wall under all operating conditions. This takes place according to the present invention by a sheet metal support member which forms in cross section an acute angle whose one leg portion abuts flat at the sealing bar and is secured at the sealing bar within the area of its edge opposite the angle apex, while the sealing diaphragm is secured to the other obliquely disposed leg thereof on the inside within the area of the angle apex, which sealing diaphragm is assembled of individual sealing lamellae which respectively overlap between two cuts or notches of the sheet metal support member and which, within the area of their overlap, are pressed against the support member by angularly bent leaf springs.

The construction and the type of the fastening of the sheet metal support member produce in cooperation with the mutually overlapping and spring-loaded sealing lamellae secured at the sheet metal support member, a seal which is characterized by a particularly large yieldingness. It is possible thereby to compensate deformations of the structural parts caused by different thermal expansions as well as changes in spacing conditioned thereby between the heat-exchanger disk and the housing wall without the danger that the edge of the sealing lamellae lifts off from the housing wall.

According to a further feature of the present invention, the cuts or notches in the sheet metal support member have respectively a V-shaped configuration and terminate in a bore, within the area of which is fastened a strip-shaped cover lamella. The shape of the cuts or notches and the covering thereof by individual strip-shaped cover lamellae secured on one side increases the yieldingness and therewith the capability of the seal to adapt itself.

Accordingly, it is an object of the present invention to provide a seal for a regenerative heat-exchanger which avoids by simple means the aforementioned shortcomings and drawbacks encountered in the prior art.

Another object of the present invention resides in a seal for a regenerative heat-exchanger which effectively avoids warpings and deformation within the edge of the sealing diaphragm.

A further object of the present invention resides in a seal for a regenerative heat-exchanger in which the danger of a lifting off of the sealing diaphragm from the housing wall is effectively minimized.

Still a further object of the present invention resides in a seal of the type described above which assures a tight abutment of the seal at the housing wall under all operating conditions.

Another object of the present invention resides in a sealing arrangement for a regenerative heat-exchanger which is characterized by a high degree of yieldingness, thus minimizing the danger of deformations caused by differing thermal expansions of the individual parts thereof.

These and further objects, features and advantages of the present invention will become more apparent from the following description when taken in connection with the accompanying drawing, which shows, for purposes of illustration only, one embodiment in accordance with the present invention, and wherein:

FIG. 2 is a plan view on the two sealing elements in accordance with the present invention abutting at one side of the storage body;

FIG. 3 is a plan view, similar to FIG. 2, on the side of a similar sealing element abutting at the storage body and on the mounting thereof at the housing;

Figure 1:
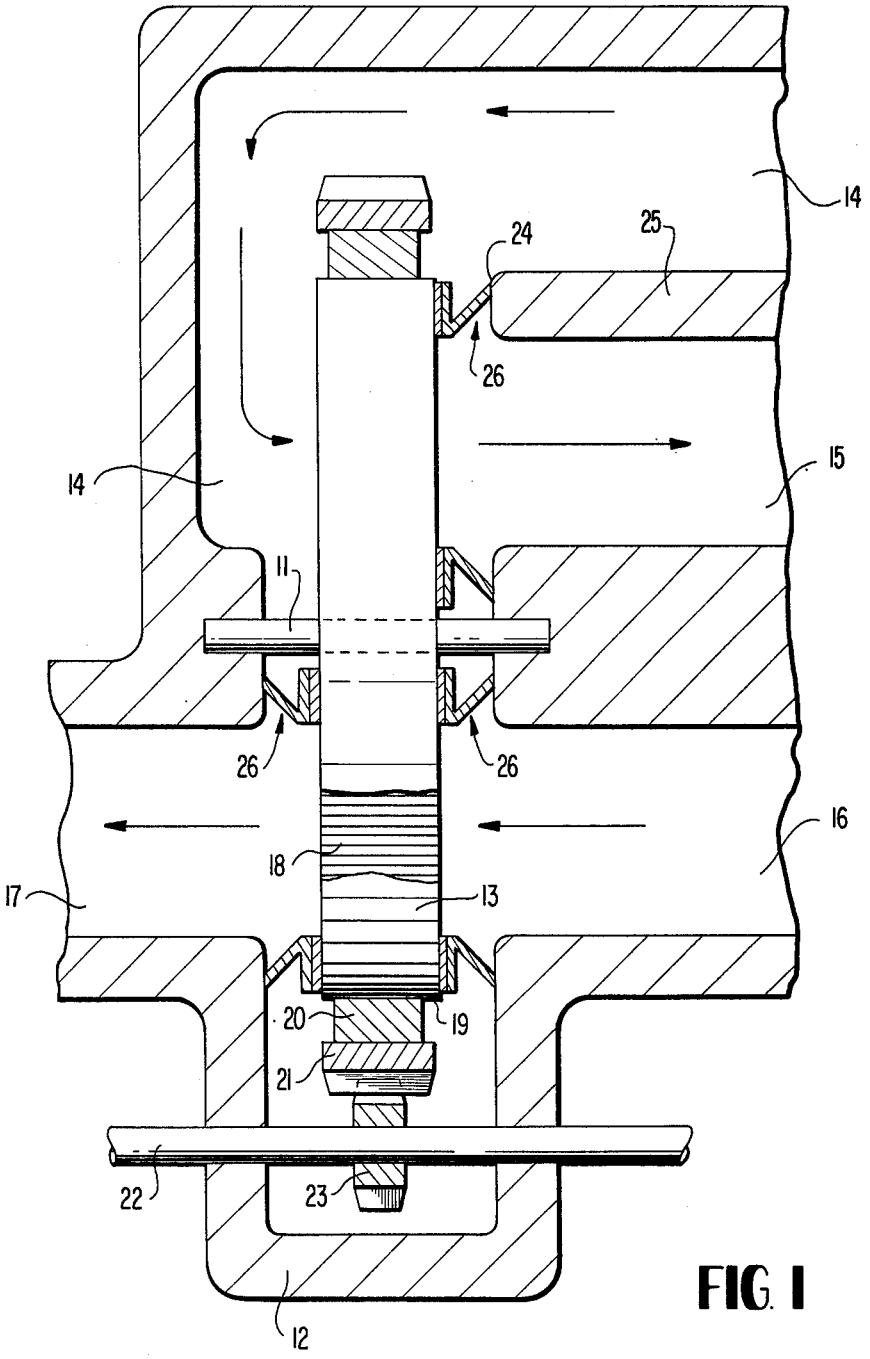
FIG. 1 is a schematic longitudinal cross-sectional view through a regenerative heat-exchanger in accordance with the present invention.

Referring now to the drawing wherein like reference numerals are used throughout the various views to designate like parts, and more particularly to FIG. 1, the regenerative heat-exchanger of a motor vehicle gas turbine, illustrated in this figure, essentially consists of a disk-shaped storage body 13 rotatably supported on a shaft 11 within a housing 12, of channels 14 and 15 for the combustion air as well as of channels 16 and 17 for the exhaust gases. The storage body 13 which is made of a glass ceramic material of conventional type, is traversed in the axial direction by a large number of small through-channels 18. A coaxial, toothed rim 21 is secured on the outer surface 19 of the storage body 13 by means of elastic intermediate members 20. A pinion 23 supported within the housing 12 on a shaft 22 engages with the toothed rim 21. The storage body 13 can be set into rotation by way of the toothed rim 21, the pinion 23 and the shaft 22 from an auxiliary drive of the gas turbine, not illustrated in detail.

During the operation of the gas turbine, the hot exhaust gases thereof are conducted through the channel 16 to the driven storage body 13, whereby the exhaust gases flow through the through-channels 18 and thereby give off a part of their heat to the storage body 13. The heated-up sections of the storage body 13 are continuously displaced into the area of the channels 14 and 15 owing to the constant rotation of the body 13. As a result thereof, the combustion air which is supplied from the compressor of the gas turbine by way of the channel 14 and which has a relatively low temperature, is able to flow into the heated-up through channels 18 and is able to absorb the heat. The heated combustion air is fed by way of the channel 15 to the combustion chamber of the gas turbine. Simultaneously, the exhaust gases which have been cooled off in the remaining section of the storage body 13, leave the housing 12 of the heat-exchanger through the channel 17.

The channels 15 to 17 possess, as can be seen from FIG. 2, an approximately semi-circularly shaped cross-sectional area within the area of the storage body 13, which permits a maximum loading of the storage body 13. D-shaped sealing elements generally designated by reference numeral 26 which correspond to the channel cross section are arranged at the end faces 24 of the walls 25 of the housing 12 which delimit the channels; the sealing elements 26 prevent at the contact places with the storage body 13 an escape of the exhaust gases or of the combustion air. No seal is necessary at the end of the channel 14 since the supplied combustion air can take only the path through the storage body 13 into the channel 15 on the inside of the housing 12 by reason of the sealing elements 26 of the remaining channels 15, 16 and 17.

FIG. 3 illustrates similar sealing elements generally designated by reference numeral 27 which may be used to seal off the channels 15 and 16 and which consist of two semi-circularly shaped arcuate portions 28 and of a rectilinear center web portion 29. The sealing elements 27 are supported between the housing 12 and the storage body 13 by retaining bolts 30 secured at the housing 12 which engage into fork-shaped extensions 31 provided at the circumference of the arcuately shaped portions 28. The retaining bolts 30 prevent during the rotation of the storage body 13 an entrainment of the sealing elements which are forced against the storage body. However, the retaining bolts 30, in cooperation with the fork-shaped extensions 31, permit axial and radial movements of the sealing elements 27 so that the position thereof can adapt itself to all operating conditions.

Figure 4:
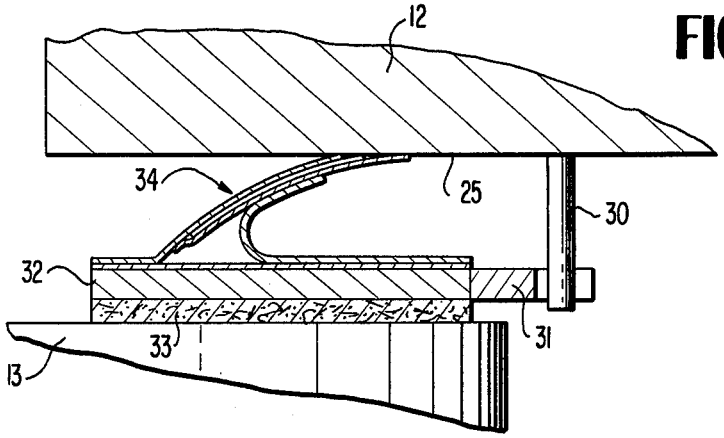
FIG. 4 is a partial cross-sectional view, on an enlarged scale, through an installed sealing element, taken along line IV—IV of FIG. 3.

Both the sealing elements 26 as also the sealing elements 27 consist, as shown in FIG. 4, essentially of a sealing bar 32 which abuts at the storage body 13 by means of a slide layer 33 and of an elastic part generally designated by reference numeral 34 which extends obliquely up to the oppositely disposed wall 25 of the housing 12 and abuts at the latter. The abutment pressure of the sealing bar 32 at the storage body 13 can be influenced by the configuration and the fastening of the elastic part 34 of the sealing elements 26 or 27. The abutment pressure is furthermore dependent on the gas pressures prevailing in the heat-exchanger. The opening of the angle formed by the sealing bar 32 and the elastic part 34 is therefore directed toward the side with the larger gas pressure so that the gas pressure assists the abutment of the sealing bar 32 and of the elastic part 34 at the storage body 13 and at the wall 25 of the housing 12. Essentially constant abutment forces are achieved by the free abutment of the sealing elements 26 and 27.

Figure 5:
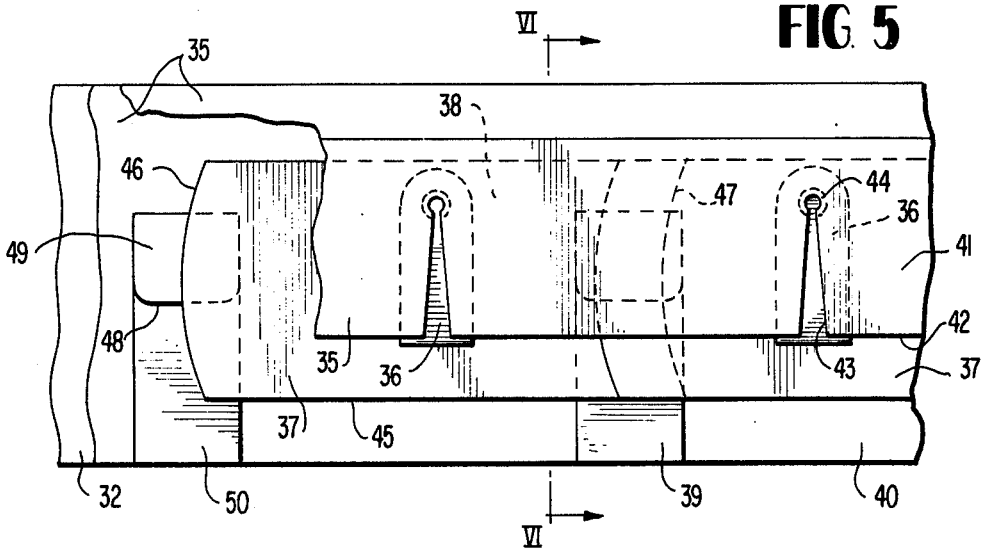
FIG. 5 is a partial plan view on the side of a part of a sealing element abutting at the housing, with the sealing element partly broken away.
Figure 6:
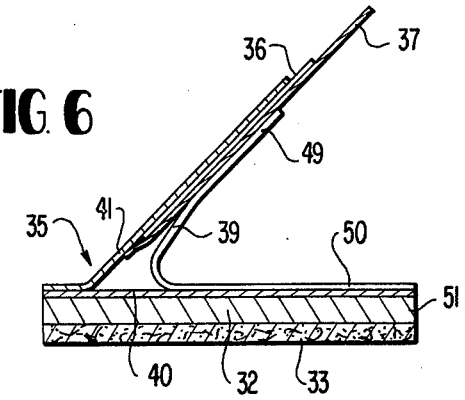
FIG. 6 is a cross-sectional view through the sealing element taken along line VI—VI of FIG. 5.

As can be seen from FIGS. 5 and 6, the elastic part 34 of a sealing element 26 or 27 consists of a sheet metal support member 35, of cover lamellae 36, of a sealing diaphragm 38 composed of sealing lamallae 37 and of leaf springs 39. The sheet metal support member 35 forms an acute angle in cross section whose one leg 40 abuts flat at the sealing bar 32 whereas the other leg 41 protrudes obliquely. Both legs 40 and 41 are connected with each other outside of the angle apex, for example, by brazing or spot-welding. Cuts or notches 43 which taper slightly V-shaped, extend from the edge 42 of the leg 41 of the sheet metal support member 35, which terminate each in a bore 44 which prevent a tearing-in of the sheet metal support member 35. The very thin strip-shaped cover lamella 36 is secured within the area of each bore 44, which cover lamella extends barely beyond the edge 42 of the support sheet metal member 35 and thereby completely covers off the groove or notch 43. The sealing lamellae 37 are secured within the area of the angle apex of the sheet metal support member 35 at the inside of the leg 41, which with their upper edges 45 project so far beyond the edge 42 of the support member 35 that they are able to abut flat at the wall 25 of the housing 12, and which laterally overlap between two notches 43 of the sheet metal support member 35. Each sealing lamella 37 includes a convex lateral edge 46 and a concave lateral edge 47 which are so arranged that the respective convex edge 46 of one sealing lamella 37 overlaps with the concave edge 47 of the adjacent sealing lamella 37. The lateral extent of the individual sealing lamellae 37 as well as the spacings of the notches 43 at the sheet metal support member 35 may vary along the circumference of the sealing elements 26 or 27. Thus, in general, the sealing lamellae 37 and the spacings or distances between the notches 43 are the shorter, the stronger the sealing elements 26 or 27 are curved within the area thereof. In practice the sealing lamellae 37 schematically illustrated in the drawing as well as the sealing lamellae 36 are thinner by a multiple than the sheet metal support member 35.

The leaf springs 39 are angularly bent. They press the sealing lamellae 37 tightly against one another within the area of their overlap by means of a slightly curved leg 49 which is slightly rounded off at the upper edge 48, whereas the leg 50 is supported at the inside of the leg 40 of the sheet metal support member 35. The end of the leg 50 of the leaf spring 39 is secured at the sealing bar 32 together with the end of the leg 40 of the sheet metal support member 35 only within the area of the edge 51 opposite of the angle apex.

The fastening of the sheet metal support member 35 and of the leaf springs 39 at the sealing bar 32 as well as of the sealing lamellae 37 and of the covering lamellae 36 at the leg 41 of the sheet metal support member 35 can take place, for example, by spot-welding or brazing. The fastening of the sheet metal support member 35 and of the sealing lamellae 37 is constructed gas-tight.

The structural elements of the elastic part 34 produce in their entirety an extraordinarily yielding seal. The subdivision of this sealing diaphragm 38 into individual sealing lamellae 37 contributes thereto considerably. In contrast to a one-piece construction, which during differing heat-up tend toward deformations and therewith become non-tight, the individual sealing lamellae 37 can adapt themselves better to changing operating conditions. Changes in spacing between the storage body 13 and the oppositely disposed wall 25 of the housing 12 can be compensated for by the great bending ability of individual sealing lamellae 37 and by differently strong overlappings of the lateral edges 46 and 47. The convexly and concavely formed edges 46 and 47 thereby produce a soft sliding of the sealing lamellae 37 one upon the other.

The adaptation of the sealing lamellae 37 at the wall 25 of the housing 12 is assisted by the sheet metal support member 35 which enables an easier spring deflection owing to the notches 43 and which precludes the danger of a buckling. The sheet metal support member 35 is able to adapt itself to differing thermal expansions and to the described changes in spacing without impairment of its support function by a more or less strong opening or closing of the cuts or notches 43. However, the adaptability of the seal is enhanced in a particular degree by the angularly bent configuration of the sheet metal support member 35 and by the fastening thereof within the area of the edge 51 of the sealing bar 32 disposed opposite the angle apex. Stresses, which would result from the differently rapid heat-up or cooling off of the relatively thick sealing bar 32 provided with the slide layer 33 and of the leg 41 of the considerably thinner sheet metal support member 35 supporting the sealing lamellae 37, can be reduced already in the leg 40 abutting at the sealing bar 32. Such a fastening of the sheet metal support member 35 only within the area of the edge 51 of the sealing bar 32 has the additional advantage that the fastening place is located always on the side of the seal which adjoins the gas with the lower temperature. The particularly endangered connecting place is therefore thermally considerably less loaded and stressed. The formation of gaps between the individual sealing lamellae 37 which must deform three-dimensionally during the spring deflection, is prevented by the leaf springs 39 which compress the overlapping edges 46 and 47 of the sealing lamellae 37. Simultaneously, the sealing lamellae 37 together with the sheet metal support member 36 are pressed by the leaf springs 39 against the wall 25 of the housing 12 so that also when during the starting of the heat-exchanger no gas pressure has built up on the inside of the angle, the sealing lamellae 37 have already completely sealed off the gas channels 15 to 17. In addition to the sealing lamellae 37, the sheet metal support member 35 together with the covering lamellae 36 covering the notches 43 form an additional seal which is able to hold back possibly escaped leakage gases.

Figure 8:
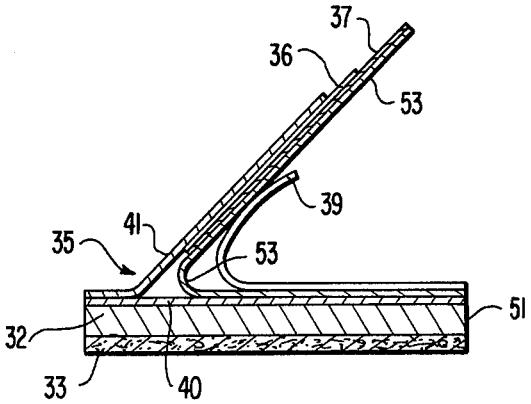
FIG. 8 is a cross-sectional view through the sealing element taken along line VIII—VIII of FIG. 7.
Figure 7:
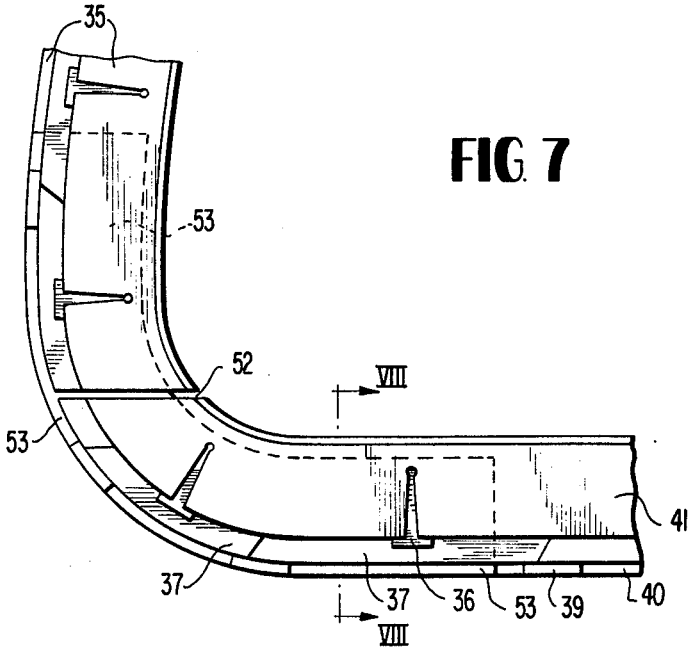
FIG. 7 is a plan view, on an enlarged scale, on the side of a corner part of a sealing element abutting at the housing.
Figure 9:
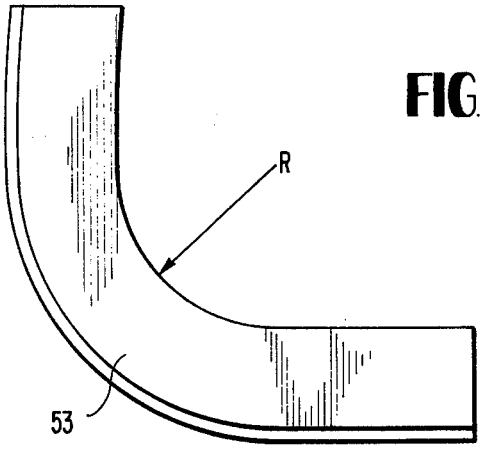
FIG. 9 is a plan view on a corner diaphragm of the sealing element of FIG. 7.

In the seals, whose sealing elements 27 are assembled as in the example according to FIG. 3 of arcuate portions 28 and of a center web 29, the center web 29 is more strongly heated up during the operation of the heat-exchanger than the arcuate portions 28. For purposes of equalizing the larger thermal expansions connected therewith, the center web 29 is inserted into the arcuate portions 28 with play in the longitudinal direction. In order to enable the relative movements caused by the thermal expansions at the joining places between the arcuate portions 28 and the center web 29, the sealing element 27, as shown in FIG. 7, is provided at these places with a separating joint or gap 52. For purposes of bridging the separating joint 52, within the area of the transition from the arcuate portions 28 to the center web 29, a corner diaphragm 53 (FIGS. 7 to 9) forming an angle in cross section and matched to the sheet metal support member 35 is inserted between the leg 40 of the sheet metal support member 35 abutting at the sealing bar 32 and the sealing lamellae 37 on the one hand, and the leaf springs 39 on the other. The abutment of the corner diaphragm 53 is improved in that the inner radius of curvature R is smaller than the corresponding radius of curvature of the sheet-metal support member 35. As a result thereof, the corner diaphragm 53 can better adapt itself to the structural parts of the sealing elements 27 disposed on both sides of the separating joint 52 which may possibly be offset relative to one another. It enables therewith a reliable seal between the storage body 13 and the oppositely disposed wall 25 of the housing 12 notwithstanding the relative movements occurring in the corner area between the arcuate portions 28 and the center web 29. The corner diaphragm 53 can be fastened by spot-welding or brazing together with the sheet metal support member 35 and the leaf springs 39 at the edge 51 of the sealing bar 32. However, it is also possible to hold the corner diaphragm 53 in its position only by the pressure of the leaf springs 39.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

What is claimed is:

1. A seal for gas channels of a regenerative heat-exchanger, the gas channels leading to a rotatable disk-shaped storage body means arranged in an interior space of a housing means surrounding the gas channels and the storage body means, the seal comprises a sealing bar means abutting with a slide layer thereof at the storage body means and a sealing diaphragm means extending obliquely over a gap between the sealing bar means and an oppositely disposed wall of the housing means, the sealing diaphragm means having an edge abutting at the oppositely disposed wall of the housing means, characterized in that a support means is provided for supporting said sealing diaphragm means, said support means is provided with notches and includes a pair of leg means forming an acute angle in cross section, one of said pair of leg means abuts substantially flat at the sealing bar means and is secured thereat within the area of an edge opposite an apex of the acute angle, the other of said pair of leg means having the sealing diaphragm means secured at an inside surface thereof, said sealing diaphragm means including individual sealing lamella means which mutually overlap between two adjacent notches of the support means, and in that angularly bent leaf spring means are provided within an area of overlap of the individual lamella means for forcing said lamella means against the support means.

2. A seal according to claim 1, characterized in that the sealing bar means is an endless sealing bar means.

3. A seal according to claim 1, characterized in that notches are covered off notches.

4. A seal according to claim 1, characterized in that the support means is a sheet metal support member.

5. A seal according to claim 1, characterized in that said one of said pair of leg means is secured to the sealing bar means only within an area of an edge thereof opposite the apex of the acute angle, and in that the sealing diaphragm means is secured on the inside of the other of said pair of leg means within the area of the apex of the acute angle.

6. A seal according to claim 1, characterized in that the notches in the support means have each a substantially V-shaped configuration and terminate in a bore, and in that a strip-shaped cover lamella means is secured within an area of each of the bores.

7. A seal according to claim 6, characterized in that each of the sealing lamellae means has a substantially convex edge and a substantially concave edge which are so arranged that the respective convex edge of one sealing lamella means overlaps with a concave edge of an adjacent sealing lamella means.

8. A seal according to claim 7, which includes arcuate portions and a center web inserted with play in a longitudinal direction, characterized in that the support means is provided with a separating gap within an area of transition from the arcuate portion to the center web, and in that a corner diaphragm means is arranged between said one of said pair of leg means and the leaf spring means, said corner diaphragm means is substantially matched to the support means and forms an angle in cross section.

9. A seal according to claim 8, characterized in that an inner radius of curvature of the corner diaphragm means is smaller than a corresponding radius of curvature of the support means.

10. A seal according to claim 9, characterized in that said one of said pair of leg means is secured to the sealing bar means only within an area of an edge thereof opposite the apex of the acute angle, and in that the sealing diaphragm means is secured on the inside of the other of said pair of leg means within the area of the apex of the acute angle.

11. A seal according to claim 1, characterized in that each of the sealing lamellae means has a substantially convex edge and a substantially concave edge which are so arranged that the respective convex edge of one sealing lamella means overlaps with a concave edge of an adjacent sealing lamella means.

12. A seal according to claim 1, which includes arcuate portions and a center web inserted with play in a longitudinal direction, characterized in that the support means is provided with a separating gap within an area of transition from the arcuate portion to the center web, and in that a corner diaphragm means is arranged between said one of said pair of leg means and the leaf spring means, said corner diaphragm means is substantially matched to the support means and forms an angle in cross section.

13. A seal according to claim 12, characterized in that an inner radius of curvature of the corner diaphragm means is smaller than a corresponding radius of curvature of the support means.

14. A seal according to claim 12, characterized in that each of the sealing lamellae means has a substantially convex edge and a substantially concave edge which are so arranged that the respective convex edge of one sealing lamella means overlaps with a concave edge of an adjacent sealing lamella means.

* * * * *